US006874613B2

(12) United States Patent
Pietz

(10) Patent No.: US 6,874,613 B2
(45) Date of Patent: Apr. 5, 2005

(54) DRIVE DEVICE FOR ESCALATORS OR MOVING WALKWAYS

(75) Inventor: Alexander Pietz, Berlin (DE)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 10/728,852

(22) Filed: Dec. 8, 2003

(65) Prior Publication Data

US 2004/0134760 A1 Jul. 15, 2004

Related U.S. Application Data

(63) Continuation of application No. PCT/EP02/05409, filed on May 15, 2002.

(30) Foreign Application Priority Data

Jun. 6, 2001 (DE) ..... 101 27 587

(51) Int. Cl.[7] ..... B66B 23/02
(52) U.S. Cl. ..... 198/330
(58) Field of Search ..... 198/330, 331, 198/832, 832.1, 834

(56) References Cited

U.S. PATENT DOCUMENTS 4,775,044 A 10/1988 Höfling
5,224,580 A * 7/1993 Nurnberg et al. ..... 198/330
6,351,096 B1 2/2002 Jang
6,450,317 B1 * 9/2002 Fargo et al. ..... 198/330
6,637,579 B2 * 10/2003 Pietz ..... 198/322
6,640,959 B1 11/2003 Haumann et al.

FOREIGN PATENT DOCUMENTS

| | | |
|---|---|---|
| DE | 100 20 787 A | 1/2001 |
| DE | 199 36 742 A1 | 2/2001 |
| DE | 199 52 168 A1 | 5/2001 |
| GB | 2 243 430 A | 10/1991 |

OTHER PUBLICATIONS

Abstract for DE 19936742.

* cited by examiner

*Primary Examiner*—Eileen D. Lillis
*Assistant Examiner*—Mark A. Deuble
(74) *Attorney, Agent, or Firm*—Venable LLP; Robert Kinberg

(57) ABSTRACT

A device for driving step of an escalator or pallets of a moving walkway. A chain wheel has a chain wheel drive shaft and is coupled to the steps or pallets. The device includes a driving gear for being coupled to the chain wheel drive shaft. The device also includes at least one driving motor coupled to the driving gear. The driving gear includes first and second gears coupled to the chain wheel drive shaft. The first and second gears each have variable reference diameters.

8 Claims, 2 Drawing Sheets

DRIVE DEVICE FOR ESCALATORS OR MOVING WALKWAYS

CROSS-REFERENCE TO RELATED APPLICATION

This application is a continuation of International Application No. PCT/EP02/05409, filed on May 15, 2002, which claims the priority of German Application No. DE 101 27 587.0 filed Jun. 6, 2001. The disclosures of the foregoing applications are incorporated herein by reference in their entirety.

BACKGROUND OF THE INVENTION

1. Field of the Invention

The invention relates to a device for driving components of an escalator or a moving walkway.

2. Related Art

It is generally known that escalators or moving walkways are indirectly or directly driven by means of electric motors. In case of an indirect drive, at least one reducing gear is provided. In case of need, power dividers can be additionally provided in a region in which mobile components of escalators or moving walkways can be driven together. Such components are the step or pallet band, as well as the handrail, if required, and if a separate drive means is not provided for the respective one. Usually the step or pallet band is displaced by means of plate link chains, the moving direction of which is changed in the reversing areas via chain wheels provided in these areas. An essential requirement of escalators and moving walkways is to enable the reversing of the step or pallet band without the undesired polygon effects and to obtain a synchronous running of the step or pallet band and the handrail, when they are driven together, so that one component does not run at a higher or lower speed than the other, which could cause passenger injuries.

In view of an optimization of the drive concept, in particular for reducing the polygon effect generated in the reversing areas, plate link chains can be used for the step or pallet band, which chains also have a greater pitch depending on the step or pallet width, for example approximately 200 or approximately 400 mm. If required, a driving motor, which runs with a non-constant speed, can be in active relation therewith. However, it is possible that these desired greater chain pitches will cause problems with respect to the polygon effect during the reversing and possibly with respect to the synchronous drive of the handrail.

OBJECTS OF THE INVENTION

Therefore, it is an object of the invention to improve a device for driving the components of an escalator or moving walkway, such that independent from the chosen chain pitch of the step or pallet band as well as the existent driving motor, the polygon effect is almost prevented in any case and a synchronous running of the associated handrail is also assured for a common drive.

SUMMARY OF THE INVENTION

The above and other objects of the invention are achieved by a device for driving the components of an escalator or moving walkway comprising at least one driving motor as well as at least one gear, which is in active relation with said components, such as a step or pallet chain driving shaft, wherein, on the side of the chain wheel shaft, at least one gear pair is provided with a variable reference diameter.

A further object of the invention is achieved by a device for driving the components of an escalator or moving walkway comprising at least one driving motor as well as at least one gear, which is in active relation with said components, such as a step or pallet chain wheel shaft as well as a handrail driving shaft, wherein, in particular on the side of the chain wheel shaft, at least one gear pair is provided with a variable reference diameter.

A further object of the invention is achieved by a device for driving step of an escalator or pallets of a moving walkway, wherein a chain wheel, having a chain wheel drive shaft, is coupled to the steps or pallets. The device includes a driving gear for being coupled to the chain wheel drive shaft; and at least one driving motor coupled to the driving gear. The driving gear includes first and second gears coupled to the chain wheel drive shaft, and the first and second gears each have variable reference diameters.

A further object of the invention is achieved by a device for driving step of an escalator or the pallets of a moving walkway, wherein a chain wheel, having a chain wheel drive shaft, is coupled to the steps or pallets. The escalator or moving walkway includes a handrail with a handrail drive shaft coupled to the handrail. The device includes a driving gear for being coupled to the chain wheel drive shaft and the handrail drive shaft, and at least one driving motor coupled to the driving gear. The driving gear includes first and second gears coupled to the chain wheel drive shaft, and the first and second gears each have variable reference diameters.

BRIEF DESCRIPTION OF THE DRAWINGS

The subject of invention is represented in the drawing by means of an exemplary embodiment and described as follows.

In the drawing.

DETAILED DESCRIPTION OF THE INVENTION

Exemplary embodiments of the invention are discussed in detail below. While specific exemplary embodiments are discussed, it should be understood that this is done for illustration purposes only. A person skilled in the relevant art will recognize that other components and configurations may be used without parting from the spirit and scope of the invention.

The polygon effects caused by greater chain pitches of the step or pallet chain and the possibly irregular driving speeds of the driving motor, which have a negative effect on the chain wheel and possibly also on the handrail wheel, are eliminated by the subjects of invention in that the polygon effect is now minimized in spite of a greater chain pitch and, if required, the handrail can also be driven uniformly with respect to the step or pallet band. The positive effects of a greater chain pitch can thus be effectively integrated in the drive concept.

The gear concept according to the invention is preferably realized by a power divider, wherein the required irregularity is obtained by means of gear pairs comprising a variable reference diameter, preferably exclusively on the side of the step or pallet chain wheel shaft, whereas, if a handrail driving shaft is present, the same one runs with constant speed.

Herein, the reference diameter varies as many times between a minimum and a maximum value on the circumference as the associated chain wheel for the driving chain of the step or pallet band has teeth.

Figure 1:
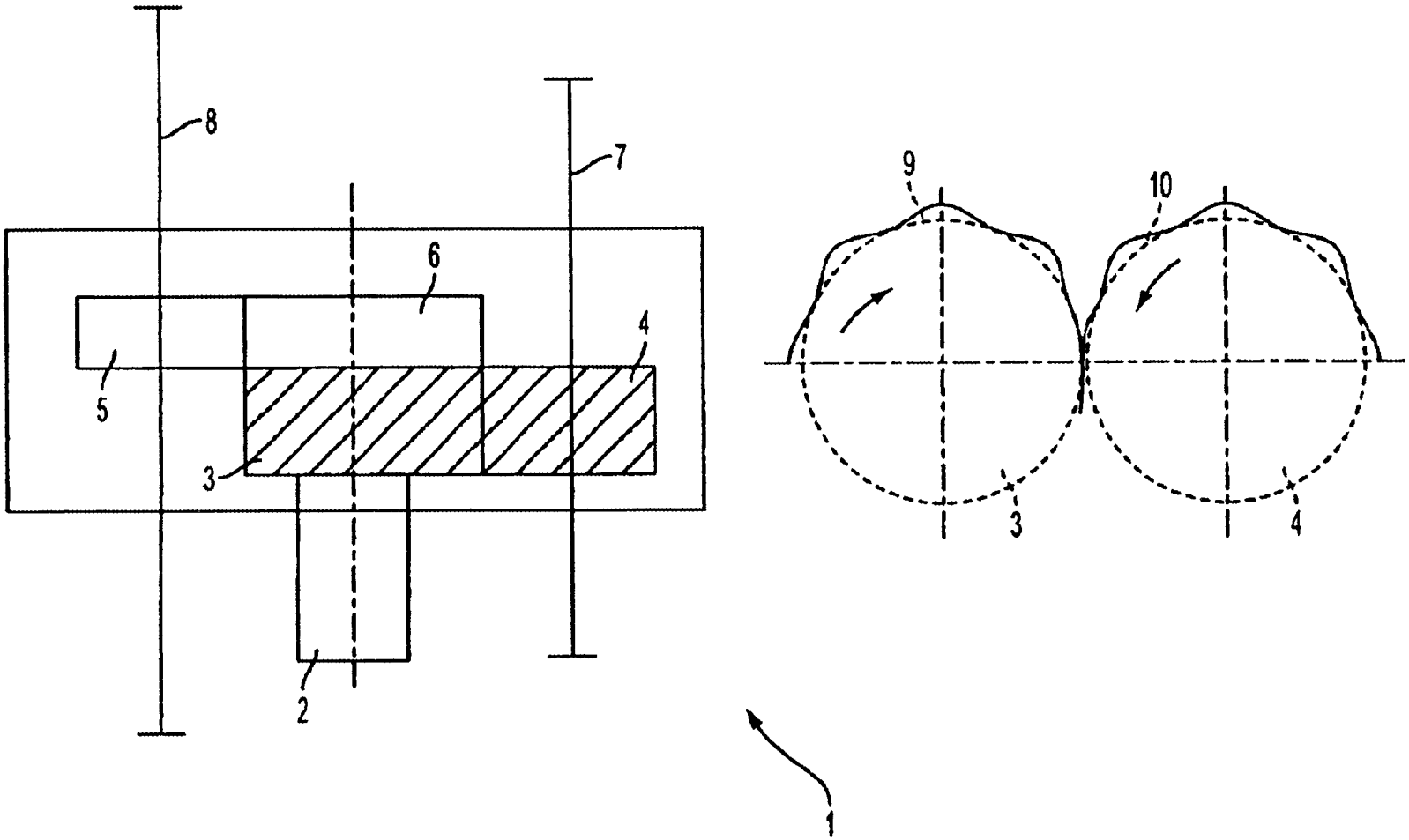
FIG. 1 is a schematic diagram of an escalator drive comprising a step and handrail drive, which can be combined.

FIG. 1 shows a power divider 1 for an escalator (not shown). Upstream of the power divider 1, there is provided a drive 2 composed of a motor and optionally a reducing gear. Within the power divider 1, gearwheels 3, 4, 5, 6 are provided, wherein the gearwheels 4 and 5 act upon a step chain wheel shaft 7, on the one hand, and a handrail driving shaft 8, on the other hand.

According to the invention the gear pair 3, 4 on the step chain wheel side is provided with a variable reference diameter 9, 10, wherein the variable reference diameter 9, 10 varies on the circumference between a minimum and a maximum value as much as the chain wheel (not shown) has teeth. The gear pair 3, 4 generates a defined irregularity, only on the side of the step chain wheel shaft 7, whereas the speed of the handrail driving shaft 8 remains constant. This drive concept is preferably used, if a greater chain pitch (dependent on the step width) of for example 200 or 400 mm is used, which requires a different compensation of the polygon effect, if the driving speed of the driving motor 2 is irregular, in order to obtain nevertheless a running at the same speed of the step or chain wheel shaft 7 and the handrail driving shaft 8.

Figure 2:
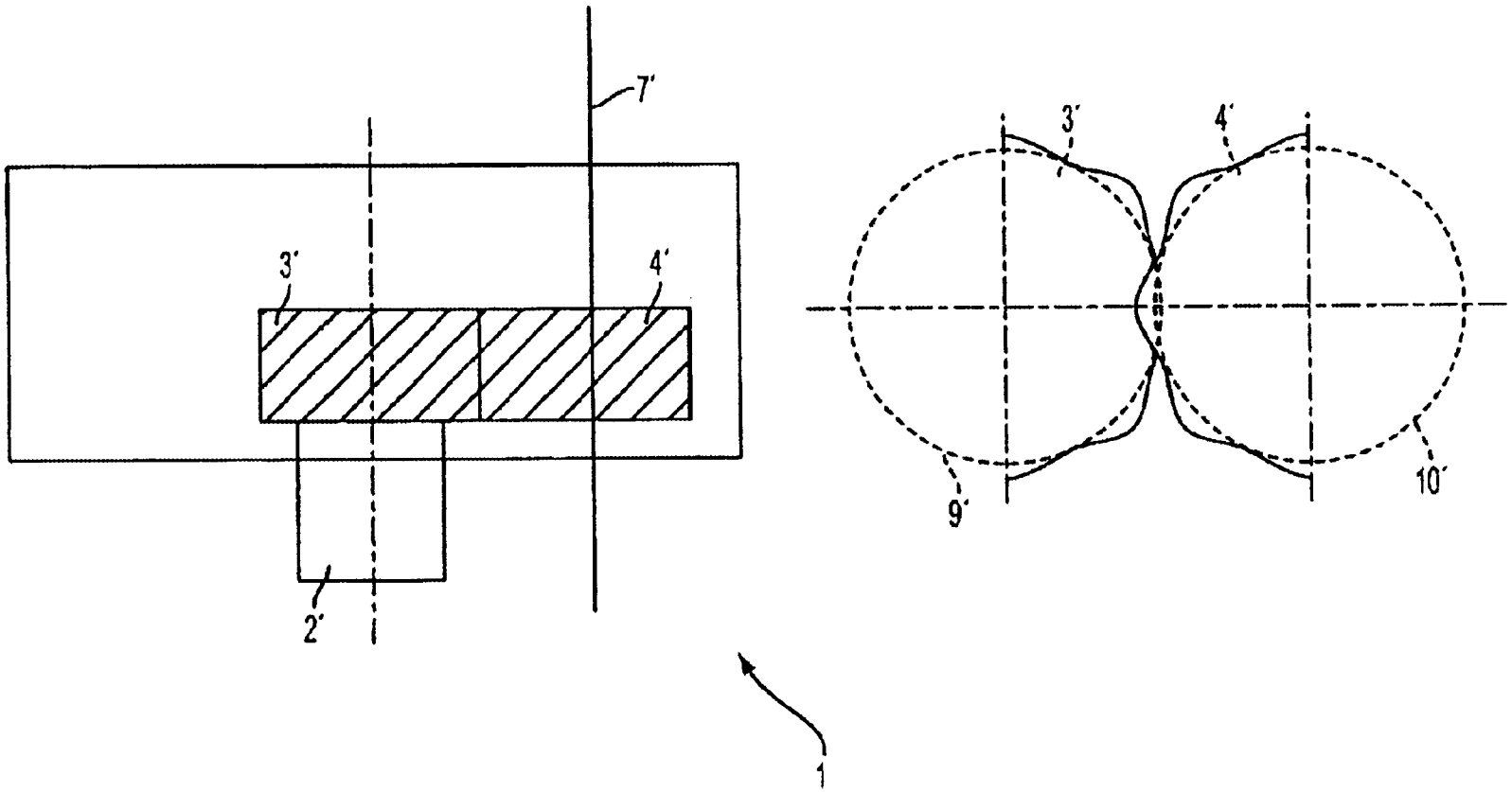
FIG. 2 is a schematic diagram of a drive of a moving walkway, in particular for the pallet band.

The schematic diagram of FIG. 2 shows a gear 1' in active relation with a driving motor 2' for use in a moving walkway (not shown). Inside the gear 1', gearwheels 3', 4' are arranged, wherein gearwheel 4' forms the main drive pinion in the direction of a pallet chain wheel shaft 7'. According to the invention and in analogy to FIG. 1, the gear pair 3', 4' on the pallet chain wheel side is provided with a variable reference diameter 9', 10'.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that the invention may be practiced otherwise than as specifically described.

What is claimed is:

1. A device for driving steps of an escalator or pallets of a moving walkway, wherein a chain wheel, having a chain wheel drive shaft, is coupled to the steps or pallets, the device comprising:

a driving gear for being coupled to the chain wheel drive shaft; and at least one driving motor coupled to the driving gear;

wherein the driving gear includes first and second gears coupled to the chain wheel drive shaft, and wherein the first and second gears each have variable reference diameters, which fluctuate in a circumferential direction between a minimum value and a maximum value.

2. The device of claim 1, wherein the driving gear is a power divider gear.

3. The device of claim 1, forming a combination with the chain wheel, wherein the chain wheel has a number of teeth and the fluctuation of the variable reference diameters of the first and second gears corresponds to the number of teeth on the chain wheel.

4. The device of claim 1, further comprising a handrail and a handrail drive shaft, wherein the steps or pallets are driven irregularly and the handrail is driven uniformly.

5. The device of claim 1, forming a combination with the chain wheel, wherein the chain wheel has a number of teeth and the fluctuation of the variable reference diameters of the first and second gears corresponds to the number of teeth on the chain wheel.

6. A device for driving steps of an escalator or pallets of a moving walkway, wherein a chain wheel, having a chain wheel drive shaft, is coupled to the steps or pallets, and the escalator or moving walkway includes a handrail with a handrail drive shaft coupled to the handrail, the device, comprising:

a driving gear for being coupled to the chain wheel drive shaft and the handrail drive shaft; and at least on driving motor coupled to the driving gear;

wherein the driving gear includes first and second gears coupled to the chain wheel drive shaft, and wherein the first and second gears each have variable reference diameters, which fluctuate in a circumferential direction between a minimum value and a maximum value.

7. The device of claim 6, wherein the driving gear is a power divider gear.

8. The device of claim 6, wherein the steps or pallets are driven irregularly and the handrail is driven uniformly.

* * * * *